US007900798B1

(12) United States Patent
Allen

(10) Patent No.: US 7,900,798 B1
(45) Date of Patent: Mar. 8, 2011

(54) DISPOSABLE CUP DISPENSER

(76) Inventor: Phyllis F. Allen, Randleman, NC (US)

( * ) Notice: Subject to any disclaimer, the term of this patent is extended or adjusted under 35 U.S.C. 154(b) by 0 days.

(21) Appl. No.: 12/125,985

(22) Filed: May 23, 2008

(51) Int. Cl.

| | |
|---|---|
| ***B65D 83/00*** | (2006.01) |
| ***B65H 1/00*** | (2006.01) |
| ***A46B 17/02*** | (2006.01) |
| ***A47K 1/08*** | (2006.01) |
| ***B23P 19/04*** | (2006.01) |

(52) U.S. Cl. ..... 221/307; 221/1; 221/63; 221/64

(58) Field of Classification Search ..... 221/22, 221/23, 25, 26, 33, 34, 36, 41, 44, 45, 61–64, 221/92, 175, 176, 185, 186, 191, 281–283, 221/287, 302–304, 307, 311

See application file for complete search history.

(56) References Cited

U.S. PATENT DOCUMENTS

| | | | | | |
|---|---|---|---|---|---|
| 1,201,963 | A | * | 10/1916 | Hill | 221/302 |
| 1,940,067 | A | * | 12/1933 | Wessman | 221/310 |
| 1,975,649 | A | * | 10/1934 | Reifsnyder | 221/308 |
| 2,520,538 | A | * | 8/1950 | Gilbertsen | 221/44 |
| 2,771,216 | A | * | 11/1956 | Reiner | 221/302 |
| 3,006,503 | A | * | 10/1961 | O'Neil | 221/307 |
| 3,295,718 | A | * | 1/1967 | Graham, Jr | 221/63 |
| 3,373,900 | A | * | 3/1968 | Staley | 221/199 |
| 3,407,966 | A | * | 10/1968 | Gauffin | 221/303 |
| 3,435,988 | A | * | 4/1969 | Pfund et al. | 221/310 |
| 3,462,044 | A | * | 8/1969 | McKenna | 221/308 |
| 3,563,411 | A | | 2/1971 | Carroll | |
| 3,604,592 | A | * | 9/1971 | Bacon et al. | 221/96 |
| D276,648 | S | | 12/1984 | Stevenson | |
| 4,489,427 | A | | 12/1984 | Allison et al. | |
| 5,199,601 | A | * | 4/1993 | Roethel | 221/310 |
| 5,839,596 | A | * | 11/1998 | Zahn et al. | 220/256.1 |
| D406,892 | S | | 3/1999 | Warren | |
| 6,347,721 | B1 | * | 2/2002 | Vine | 220/831 |
| 6,457,592 | B1 | * | 10/2002 | Rozen | 211/65 |
| 6,905,244 | B2 | | 6/2005 | Kilcher et al. | |
| 7,033,075 | B2 | | 4/2006 | Landis et al. | |
| 7,290,928 | B2 | | 11/2007 | Calderwood et al. | |
| 2007/0121789 | A1 | | 5/2007 | Steck et al. | |

FOREIGN PATENT DOCUMENTS

WO PCT/US2006/005435 2/2006

* cited by examiner

*Primary Examiner* — Gene Crawford
*Assistant Examiner* — Kelvin L Randall, Jr.
(74) *Attorney, Agent, or Firm* — Daniel C. Leonardi; Nexsen Pruet, LLC

(57) ABSTRACT

A disposable cup dispenser designed to be mounted on an existing wall-mounted cup holder. The cup dispenser is comprised of a hollow tube and gasket ring wherein the gasket ring is attached to the bottom of the hollow tube and serves as the means of mounting the dispenser to the cup hole of the wall-mounted cup holder. The hollow tube or the gasket ring contains means for ensuring that only one cup is dispensed at a time. Cups are then dispensed downwardly out of the hollow tube and through the gasket ring and cup holder. The dispenser may also have a hinged or removable top.

14 Claims, 3 Drawing Sheets

DISPOSABLE CUP DISPENSER

CROSS REFERENCE TO RELATED PATENTS

Figure 1:
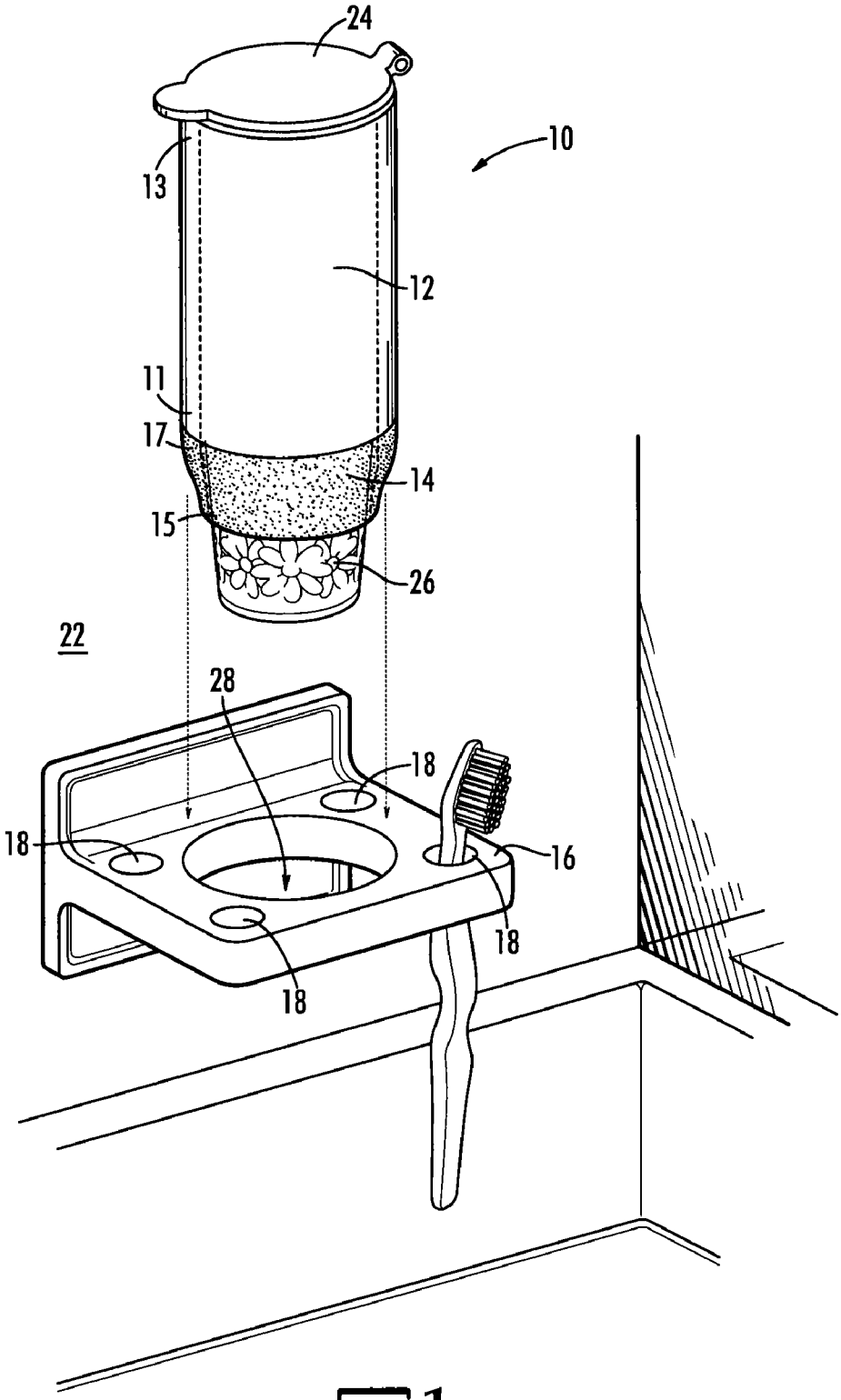

N/A.

BACKGROUND OF THE INVENTION

The present invention relates generally to disposable cup dispensers and specifically to disposable cup dispensers to be used in a bathroom or washroom and mounted on an existing wall-mounted cup holder.

Many homes, apartments, and a condominiums, particularly older homes, apartments, and condominiums, have installed in the bathroom or washroom a wall-mounted cup holder. These cup holders are typically ceramic, glass, plastic, or metal, and are rigidly and permanently affixed to the wall several inches above the bathroom counter or backsplash. The wall-mounted cup holder typically consists of a vertical wall flange with a horizontal cup-holding ring attached thereto. The cup-holding ring often has slots or holes arrayed around it for storing toothbrushes.

Wall-mounted cup holders typically come with a cup that is dimensioned to be received in the cup-holding ring but too large to pass entirely through the cup-holding ring. The cup is usually made of the same material as the cup holder. If the cup is ceramic, glass, or plastic, the cup is easily broken if dropped on a hard surface, like a hard bathroom countertop or ceramic tile floor. Moreover, if children are using the bathroom or washroom, the cup can become lost or inadvertently thrown in the trash. When the cup is broken or lost, it can be difficult to find a replacement cup that fits appropriately. Accordingly, there is a need for a replacement for the old-fashioned cup holder with a single cup.

Another problem with old-fashioned wall-mounted cup holders is that they are not sanitary. First, there is just one cup. If the bathroom is being used by two or more people, the users will be faced with using the same cup and thereby exchanging contagions. This is especially true if the users are ill and are using the cup to take medicines (e.g., swallow pills and capsules). In addition, because people often use the cup to rinse out their mouths after brushing their teeth, the cup is usually fouled with toothpaste residue.

Equipping bathrooms and washrooms with small disposable cups solves many of the problems associated with old-fashioned wall-mounted cup holders. First, the inconvenience associated with losing or breaking the cup is alleviated. Next, the sanitation issues described above are alleviated. Although the breakage, loss, and sanitation issues are resolved, a number of new problems can be introduced if disposable cups are used. For example, if the disposable cups are placed in a stack on the rim of the sink or on the countertop, they consume part of the limited space surrounding the sink. This is especially true if the sink is contained in a small vanity or mounted without a vanity at all (e.g., pedestal sinks and cantilever-mounted sinks). Of course, the cups cannot be placed in the cup holder because they would pass right through the cup-holding ring. In addition, stacks of cups on the countertop or side of the sink are easily knocked over.

If the cups are placed in a dispenser (e.g., cardboard or plastic box), they consume even more of the limited space surrounding the sink or on the countertop. Finally, if the box is placed on the wall-mounted cup holder, it is easily knocked off and broken and will obstruct the toothbrush slots of the cup holder. Accordingly, there is a need for a disposable cup dispenser that does not consume space around the sink or on the countertop and which can be easily attached, removed, and refilled. Furthermore, there is a need for such a dispenser that attaches to an existing wall-mounted cup holder without obstructing the toothbrush slots in the holder.

Another problem with wall-mounted cup holders is that they are not easily removed (e.g., for repair or replacement). The wall-mounted cup dispenser is permanently attached directly to the wall with lag screws, wood screws, drywall fasteners, or other means known in the art. Removal of the cup holder, therefore, leaves the wall scarred with unsightly holes. This problem is greatly exacerbated when the wall to which the wall-mounted cup holder is fastened is covered with ceramic tile or wainscoting. If the wall is covered in ceramic tile or wainscoting, repair costs are even higher as tiles or sheets of wainscoting must be replaced. Accordingly, there is a need for a method of converting a wall-mounted cup holder to a disposable cup dispenser that does not require removing the wall-mounted cup holder.

SUMMARY OF THE INVENTION

According to its major aspects and briefly recited, the present invention is a disposable cup dispenser designed specifically to reside on and be frictionally attached to an existing wall-mounted cup dispenser.

In a preferred embodiment, the disposable cup dispenser of the present invention is comprised of three major components: a hollow tube, a gasket ring, and a top. The hollow tube is dimensioned to receive and store a stack of disposable cups (e.g., 3 oz. Dixie® bath cups) to be downwardly dispensed therefrom. Attached to the bottom end of the hollow tube is the gasket ring, which is dimensioned to be received in but not pass entirely though the cup hole of a wall-mounted cup holder. Attached to the top end of the hollow tube is a removable or hinged top, which permits the hollow tube to be filled with cups without removing the entire cup dispenser from the wall-mounted cup holder.

A special feature of the present invention is the gasket ring. In order to be received into but not pass through the cup hole of a wall-mounted cup holder, the gasket ring's outside dimension tapers inward from top to bottom with the diameter at the top being larger than the diameter of the cup hole of the wall-mounted cup holder and the diameter at the bottom being smaller than the cup hole of the wall-mounted cup holder. In addition to the tapered shape, the gasket ring is deformable so that when it is pressed and/or twisted into the upward-facing hole of the wall-mounted cup holder, the gasket becomes securely lodged therein. With the gasket ring firmly attached to the wall-mounted cup holder, the cup dispenser cannot be tipped over easily.

Another feature of the present invention relates to the outside diameter of the gasket ring and hollow tube. Both the gasket ring and the hollow tube have outside diameters that are sufficiently small so that they do not obstruct the toothbrush slots of the wall-mounted cup holder. That is, when the disposable cup dispenser of the present invention is mounted in and secured to the wall-mounted cup holder, the toothbrush slots remain accessible such that toothbrushes can be easily inserted and removed therefrom.

Another feature of the present invention is a disposable cup dispenser that downwardly dispenses only one cup at a time out of a wall-mounted cup holder. The means for ensuring that only one disposable cup is dispensed at a time can be located in the hollow tube or the gasket ring. The prior art is replete with examples of such means including but not limited to tabs, protrusions, fingers, shoulders, constrictions, springs, and/or leaves designed to snag, bear upon, or otherwise ensure that the cups are dispensed, one at a time, in an orderly fashion.

Another feature of the present invention is a method of converting a wall-mounted cup holder into a wall-mounted disposable cup dispenser. In a preferred embodiment of the present invention, the method includes the steps of (1) providing a disposable cup dispenser comprised of a hollow tube, means for ensuring that only one disposable cup is dispensed at a time, a gasket ring, and a hinged lid, wherein the gasket ring is dimensioned to be received into the cup hole of a wall-mounted cup holder without obstructing the toothbrush slots in the wall-mounted cup holder, (2) securing the disposable cup dispenser in the wall-mounted cup holder by inserting, pressing, and twisting the gasket ring into the hole of the wall-mounted cup holder, (3) opening the hinged lid of the hollow tube of the disposable cup dispenser, (4) inserting cups into the hollow tube with the bottoms of the cups facing downward so that the cups can be downwardly dispensed from the hollow tube and out of the gasket ring, and (5) closing the lid of the hollow tube.

These and other features and their advantages will be apparent to those skilled in the art from a careful reading of the Detailed Description of Preferred Embodiments.

DETAILED DESCRIPTION OF PREFERRED EMBODIMENTS

The present invention is a disposable cup dispenser designed specifically to be mounted on an existing wall-mounted cup holder. The following detailed description of a preferred embodiment of the invention is just one example of the possible versions of the present invention and is not presented as the only embodiment and should not be seen as limiting the scope of the invention claimed herein.

In the drawings, FIG. 1 shows the disposable cup dispenser of the present invention 10 suspended over the wall-mounted cup holder 16, which is rigidly attached to wall 22. Note that FIG. 1 shows the disposable cup dispenser 10 just before it is lowered onto and attached to wall-mounted cup holder 16. That is, prior to insertion of the deformable gasket ring 14 into cup hole 27 of the wall-mounted cup holder 16 so that cups 26 can be dispensed downwardly out of the cup dispenser.

Hollow tube 12, having a first end 11 and a second end 13, serves as the main housing for cups 26 and can be made of any rigid material such as plastic, glass, cardboard, wood, or metal. Below hollow tube 12 and attached thereto is gasket ring 14, which has a first end 15 and a second end 17. The first end 15 of gasket ring 14 is the end from which cups 26 are dispensed. The second end 17 of gasket ring 14 is attached to the first end 11 of hollow tube 12. Gasket ring 14 can be attached to hollow tube 12 by any means known in the art. For example, gasket ring 14 could be glued or threaded onto hollow tube 12. Alternatively, gasket ring 14 could be affixed to hollow tube 12 simply by friction. Gasket ring 14 could also be attached to hollow tube 12 via a tongue-and-groove arrangement (see FIG. 3).

An important feature of gasket ring 14 is that the outside diameter of the first end 15 of gasket ring 14 is dimensioned to fit inside the cup hole 28 of a wall-mounted cup holder 16. The outside dimension of second end 17, however, is larger than cup hole 28 so that gasket ring 14 cannot pass entirely through cup hole 28. This ensures that the disposable cup holder 10 remains on top of and does not fall through cup hole 28 of wall-mounted cup holder 16.

Another important feature of gasket ring 14 is that it is deformable. That is, gasket ring 14 is made of an elastic material such as foam rubber, urethane foam, PVC foam, or cork. Alternatively, gasket ring 14 could be a sac or shell filled with air, water, or a gel. The deformability of gasket ring 14 permits it to be firmly seated within cup hole 28, such that hollow tube 12 and the rest of the disposable cup dispenser 10 do not tip over and off of wall-mounted cup holder 16.

Figure 2:
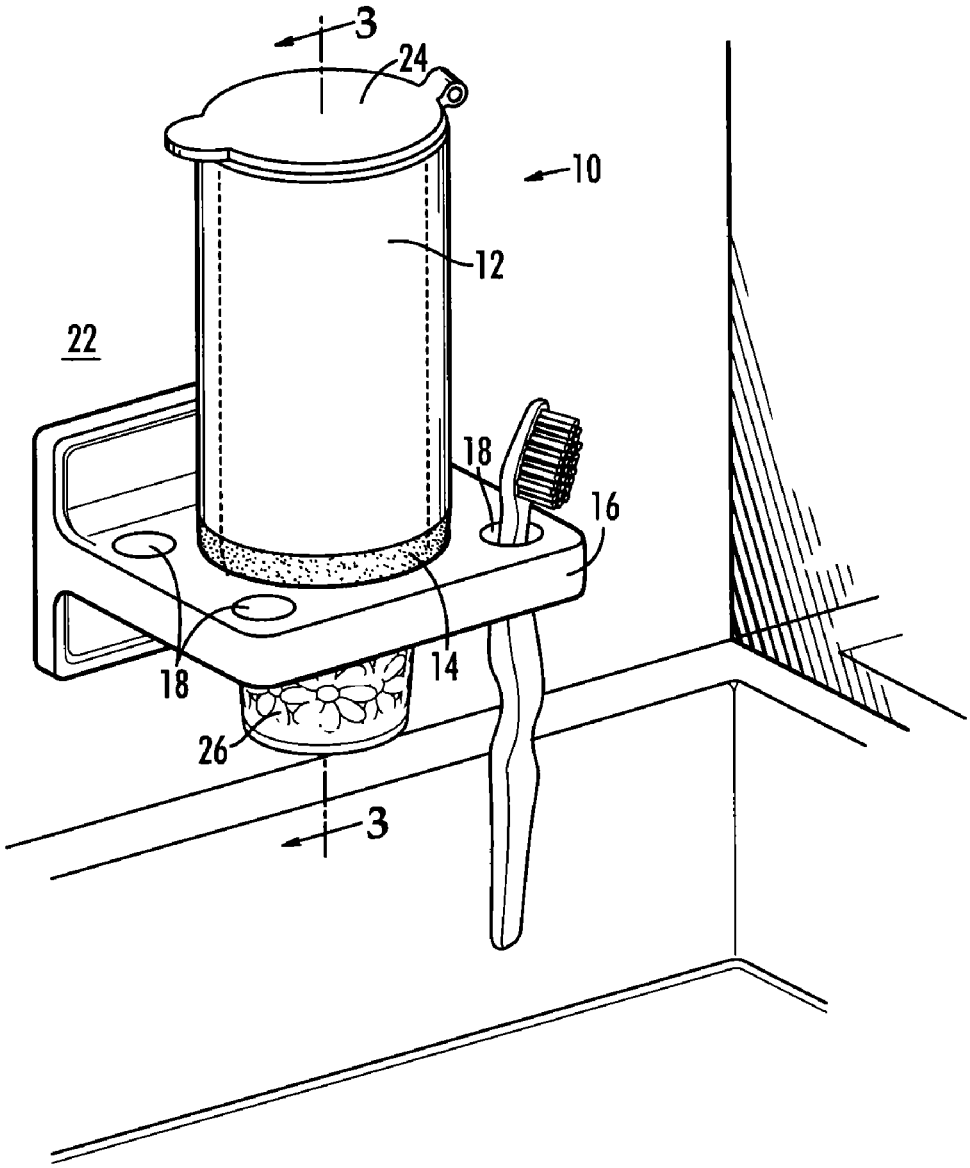

FIGS. 1 and 2, respectively, show the disposable cup dispenser 10 just prior to and after it is mounted on wall-mounted cup holder 16. To mount cup dispenser 10 in wall-mounted cup holder 16, the user simply inserts the first end 15 of gasket ring 14 into cup hole 28. After the first end 15 of gasket ring 14 is inserted into cup hole 28, the user, holding gasket ring 14 and/or hollow tube 12, gently presses down and twists gasket ring 14 so that it is snuggly seated into cup hole 28.

The disposable cup dispenser 10 can be attached to the wall-mounted cup holder 16 regardless of whether hollow tube 12 contains cups 26. If the hollow tube 12 contains cups 26 when the disposable cup dispenser 10 is attached to the wall-mounted cup holder 16, the dispenser 10 is ready to use and cups 26 can be dispensed downwardly out of disposable cup dispenser 10. If disposable cup dispenser 10 does not contains cups 26 when it is attached to wall-mounted cup holder 16, the user can simply fill the dispenser 10 with cups 26 by opening hinged top 24 and placing cups 26 into hollow tube 12. After loading, the dispenser 10 is ready to use and cups 26 can be dispensed downwardly out of disposable cup dispenser 10.

Although the preferred embodiment of the disposable cup dispenser 10 of the present invention shown in FIGS. 1 and 2 is equipped with a lid 24 that is hinged, the lid 24 could be attached to hollow tube 12 in other ways. For example, the lid 24 could be threaded onto or tethered to hollow tube 12 or simply kept on hollow tube 12 by its own weight. Alternatively, the lid 24 could be frictionally attachable to but completely removable from hollow tube 12.

Note that the outside diameter of hollow tube 12 is sufficiently small to ensure that toothbrush slots 18 of wall-mounted cup holder 16 are not obstructed. Accordingly, the present invention allows the user to combine the toothbrush storing features of a wall-mounted cup holder 16 with the sanitary features of a disposable cup dispenser 10.

FIGS. 1 and 2 also show a preferred embodiment of the method of the present invention. Specifically, these figures show the conversion of a wall-mounted cup holder 16 into a wall-mounted disposable cup dispenser 10 (FIG. 2). This embodiment of the method of the present invention includes the following steps: (1) providing a disposable cup dispenser 10 comprised of a hollow tube 12, means for ensuring that only one disposable cup is dispensed at a time (see tabs 19 of FIG. 3), a gasket ring 14, and a hinged lid 24, wherein the gasket ring 14 is dimensioned to be received into the cup hole 28 of a wall-mounted cup holder 16 without obstructing the toothbrush slots 18 in the wall-mounted cup holder 16, (2) securing the disposable cup dispenser 10 in the wall-mounted cup holder 16 by inserting, pressing, and twisting the gasket ring 14 into the hole 28 of the wall-mounted cup holder 16, (3) opening the hinged lid 24 of the hollow tube 12 of the disposable cup dispenser 10, (4) inserting cups 26 into the hollow tube 12 with the bottoms of the cups 26 facing downward so that the cups 26 can be downwardly dispensed from the hollow tube 12 and out of the gasket ring 14, and (5) closing the lid 24 of the hollow tube 12.

Figure 3:
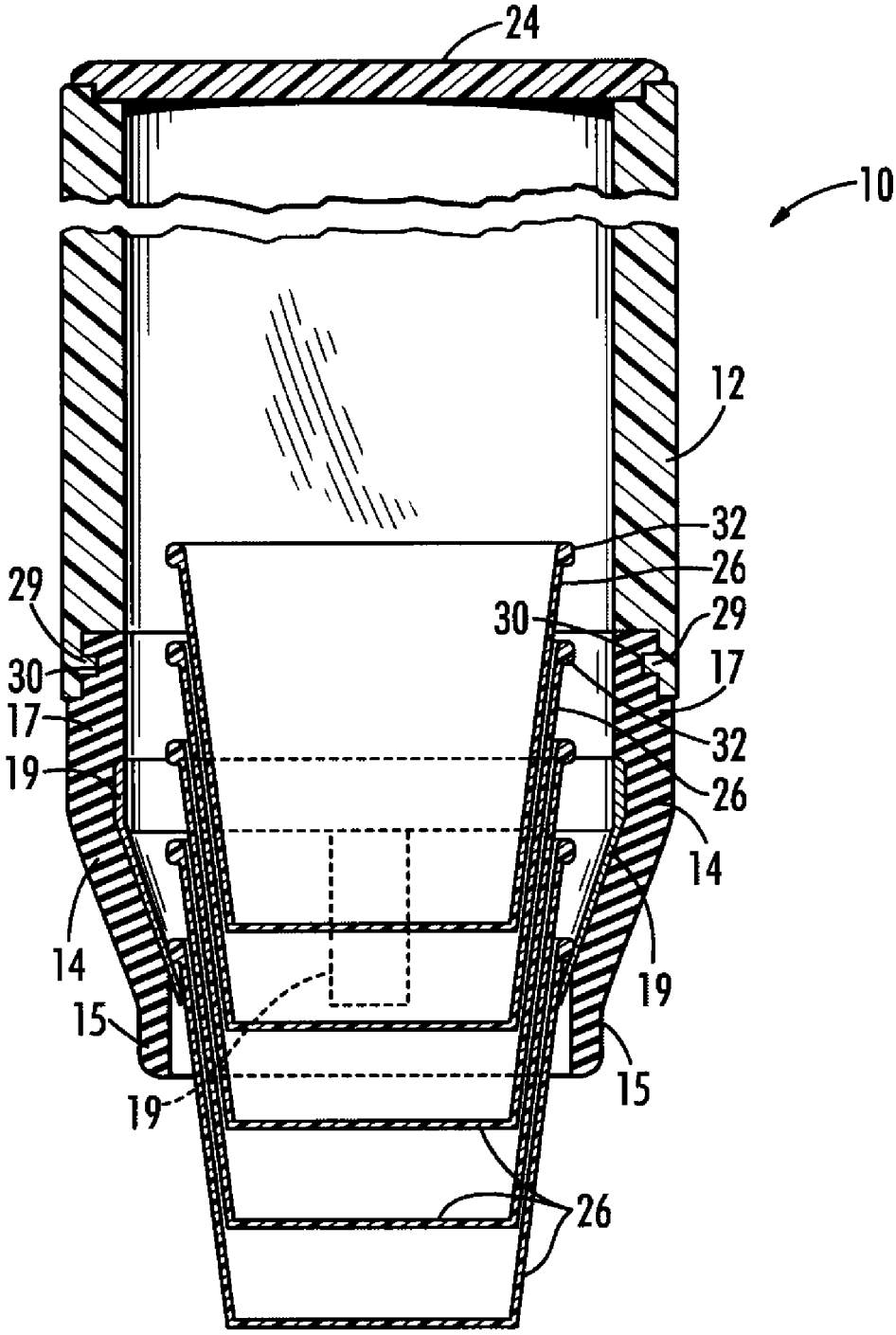

FIG. 3 is a cross-sectional view of the disposable cup dispenser 10 of the present invention, showing the interface of the hollow tube 12, gasket ring 14 and cups 26. Note that lid 24 shown in this embodiment, in contrast to lids 24 of the embodiment in FIGS. 1 and 2, which were hinged, is held on simply by its own weight and is not secured to hollow tube 12 or otherwise tethered to disposable cup dispenser 10. Note also in FIG. 3 that gasket ring 14 is attached to hollow tube 12 via a tongue and groove arrangement, with the tongue 29 of hollow tube 12 fitting into the groove 30 of gasket ring 14. Of course, any arrangement that securely attaches gasket ring 14 to hollow tube 12 would suffice, including fusing, gluing, threading or using any other fastener or fastening means known in the art.

FIG. 3 also shows that gasket ring 14 is inwardly tapered from top to bottom. That is, first end 15 of gasket ring 14 is narrower than second end 17 of gasket ring 14. This enables gasket ring 14 to be securely seated into the cup hold of 28 of wall-mounted cup holder 16 (FIGS. 1 and 2). Finally, FIG. 3 shows the manner in which the cups 26 reside in hollow tube 12 and gasket ring 14 and the means for ensuring that only one cup 26 is dispensed at a time. In this particular embodiment of the present invention, flexible tabs 19 are located in and attached to gasket ring 14. Tabs 19 project downwardly and inwardly and catch the rims 32 of cups 26, thereby ensuring that only one cup 26 is dispensed at a time. Note that although tabs 19 in FIG. 3 are attached to gasket ring 14, they could, alternatively, be attached to hollow tube 12. The tabs 19 could also be integral to gasket ring 14 or hollow tube 12.

Although FIG. 3 shows tabs 19 as the means for ensuring that only one cup 26 is dispensed at a time, there are many other devices and configurations that are capable of serving the same function and the embodiment shown in FIG. 3 is not intended to limit the present invention to that particular design. The following patents disclose additional means for ensuring that only one cup is dispensed at a time: U.S. Patent App. Pub. No. 2003/022098 (disclosing dispensing rings with tabs); U.S. Pat. No. 4,163,508 (disclosing semicircular cardboard tabs); U.S. Pat. No. 3,669,307 (disclosing projections and recesses in the inner wall of the dispensing tube); U.S. Pat. No. 3,563,411 (disclosing integral projections); U.S. Pat. No. 3,435,988 (disclosing hook-like resilient fingers); U.S. Pat. No. 3,261,500 (disclosing cup-retaining projections having rounded shoulders); U.S. Pat. No. 2,740,551 (disclosing shoulders bearing on the outside rim of the bottom-most cup); U.S. Pat. No. 2,614,687 (disclosing resilient lips); U.S. Pat. No. 2,487,736 (disclosing spring fingers).

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A disposable cup dispenser for use with a wall-mounted cup holder having a cup hole, said disposable cup dispenser comprising:

a hollow tube dimensioned for receiving a stack of disposable cups therein, said hollow tube having a first end and an opposing second end;

a deformable gasket ring having a first end, an opposing second end, and an outside diameter; said outside diameter of said gasket ring being inwardly tapered from said second end to said first end so that said first end of said gasket ring is dimensioned to be received into a cup hole of a wall-mounted cup holder but not said second end so that, when said gasket ring is pressed into said cup hole, said gasket ring deforms and becomes lodged in said cup hole, said first end being below said cup hole and said second end being above said cup hole, wherein said first end of said hollow tube is carried by said second end of said gasket ring so that each cup of said stack of disposable cups is dispensable from said hollow tube through said first end of said gasket ring; and means proximate said first end of said hollow tube for dispensing said each cup of said stack of cups so that one cup is dispensed at a time.

2. The disposable cup dispenser of claim 1, wherein said wall-mounted cup holder is equipped with toothbrush slots and said gasket ring and said hollow tube are dimensioned to not obstruct said toothbrush slots when said disposable cup dispenser is installed in said cup hole of said wall-mounted cup holder.

3. The disposable cup dispenser of claim 1, wherein a hinged lid is attached to said second end of said hollow tube, said hinged lid having an opened position and a closed position, said disposable cups being placed into said hollow tube when said lid is in said opened position.

4. The disposable cup dispenser of claim 1, wherein said gasket ring is made of plastic.

5. The disposable cup dispenser of claim 1, wherein said gasket ring is made of foam rubber.

6. The disposable cup dispenser of claim 1, wherein said gasket ring is made of urethane foam.

7. The disposable cup dispenser of claim 1, wherein said gasket ring is made of PVC foam.

8. The disposable cup dispenser of claim 1, further comprising a stack of disposable cups positioned within said hollow tube.

9. The disposable cup dispenser of claim 1, wherein said gasket ring has an annular groove dimensioned to receive said first end of said hollow tube.

10. The disposable cup dispenser of claim 1, wherein said means for dispensing is carried by said gasket ring.

11. The disposable cup dispenser of claim 8, wherein each of said disposable cups has a capacity of about 3 oz.

12. The disposable cup dispenser of claim 8, wherein each of said disposable cups has a capacity of about 5 oz.

13. A method of converting a wall-mounted cup holder to a disposable cup dispenser, said method comprising the steps of:

(a) providing a disposable cup dispenser comprising a hollow tube having a first end and an opposing second end, and a deformable gasket ring having a first end, an opposing second end, and an outside diameter; said second end of said gasket ring having an annular groove dimensioned for said first end of said hollow tube, said diameter of said gasket ring being inwardly tapered from said second to said first end so that said first end of said gasket ring is dimensioned to be received into a cup hole of a wall-mounted cup holder but not said second end so that, when said gasket ring is pressed into said cup hole, said gasket ring deforms and becomes lodged in said cup hole, said first end of said gasket ring being below said cup hole and said second end being above said cup hole;

(b) placing said first end of said gasket ring into said cup hole of said wall-mounted cup holder to seat said gasket ring in said wall-mounted cup holder until said gasket ring deforms and becomes lodged in said cup holder; and (c) depositing a stack of cups into said hollow tube through said second end of said hollow tube.

14. The method of claim 13, wherein said second end of said hollow tube has a hinged lid, and said depositing step further comprises the steps of:

rotating said lid to an open position;

depositing said stack of cups into said second end of said hollow tube; and rotating said lid to a closed position.

* * * * *